US005417085A

United States Patent [19]

Regev

[11] Patent Number: 5,417,085

[45] Date of Patent: May 23, 1995

[54] RING HAVING INTERCHANGEABLE FINGER SIZED PORTIONS

[75] Inventor: Eyal Regev, Kfar Shmaryahu, Israel

[73] Assignee: Cartelle Ltd., Ramat Gan, Israel

[21] Appl. No.: 44,176

[22] Filed: Apr. 8, 1993

[30] Foreign Application Priority Data

Oct. 5, 1992 [IL] Israel ..... 103349

[51] Int. Cl.[6] ..... A44C 9/00

[52] U.S. Cl. ..... 63/15.2; 63/15.3; 63/15.5

[58] Field of Search ..... 63/15–15.7

[56] References Cited

U.S. PATENT DOCUMENTS

| | | | |
|---|---|---|---|
| 1,186,271 | 6/1916 | Block | 63/15.2 |
| 1,599,811 | 9/1926 | Eliasoff | 63/15.3 |
| 1,822,392 | 9/1931 | Esterman | 63/15.4 |
| 2,055,315 | 9/1936 | Sessa . | |
| 2,060,345 | 11/1936 | Phillips | 63/15.3 |
| 2,332,344 | 10/1943 | Roskin | 63/15 |
| 3,606,767 | 9/1971 | Auchere et al. . | |
| 3,833,010 | 9/1974 | McDermott et al. . | |
| 4,223,541 | 9/1980 | Martinez . | |
| 4,261,185 | 4/1981 | Martinez . | |
| 4,311,026 | 6/1982 | Ochoa | 63/15 |
| 4,357,694 | 11/1982 | Montuori . | |
| 4,493,196 | 9/1983 | Bogner . | |
| 4,526,016 | 7/1985 | Cercone . | |
| 4,592,211 | 6/1986 | Ross . | |
| 4,697,437 | 10/1987 | D'Annunzio . | |
| 4,753,087 | 6/1988 | D'Annunzio . | |
| 4,916,924 | 4/1990 | Borgenicht . | |
| 5,131,243 | 7/1992 | Coleman . | |
| 5,161,392 | 11/1992 | Wiriath | 63/15.7 |

FOREIGN PATENT DOCUMENTS

| | | | |
|---|---|---|---|
| 25697 | 3/1883 | Austria | 63/15.1 |
| 496575 | 10/1953 | Canada | 63/15.2 |
| 759302 | 11/1933 | France . | |
| 842140 | 2/1938 | France | 63/15.4 |
| 1437684 | 3/1965 | France | 63/15 |
| 518718 | 5/1971 | France | 63/15.4 |
| 3640807 | 6/1988 | Germany . | |
| 1224607 | 3/1971 | United Kingdom . | |

*Primary Examiner*—Flemming Saether
*Attorney, Agent, or Firm*—Cushman, Darby & Cushman

[57] ABSTRACT

A ring including an ornamental ring portion, and a pair of flanges which are removably mounted onto the ornamental ring portion, the internal diameter of the pair of flanges being sized to fit a user's finger.

8 Claims, 4 Drawing Sheets

RING HAVING INTERCHANGEABLE FINGER SIZED PORTIONS

FIELD OF THE INVENTION

The present invention relates to jewelry generally and more particularly to rings.

BACKGROUND OF THE INVENTION

Recently, rings comprising a finger engaging portion and an annulus mounted thereon and rotatable about the finger have become popular. Such rings encounter a difficulty which is characteristic of most rings, they are constructed for a finger of a given size and cannot readily be adapted for different sized fingers.

Over the years, various techniques and constructions have been developed to enable rings to be readily adapted to fit differently sized fingers. Examples of such techniques and constructions appear in the following U.S. Pat. Nos. 2,055,315; 3,606,767; 3,933,010; 4,223,541; 4,261,185; 4,357,694; 4,592,211; 4,697,437; 4,753,087; 4,916,924 and 5,131,243.

SUMMARY OF THE INVENTION

The present invention seeks to provide a modular ring construction which is easily adapted to fit differently sized fingers.

There is thus provided in accordance with a preferred embodiment of the present invention a ring including an ornamental ring portion, and a pair of flanges which are removably mounted onto the ornamental ring portion, the internal diameter of the pair of flanges being sized to fit a user's finger.

There is also provided in accordance with a preferred embodiment of the present invention a ring including an inner ring portion, an outer generally annular portion which is arranged to be rotatably mounted onto the inner ring portion and which need not be matched to the finger size of the user and apparatus for removably retaining the outer generally annular portion in rotatable mounting engagement with the interchangeable inner ring portion.

In accordance with a preferred embodiment of the present invention, the apparatus for removably retaining includes a pair of flanges which are removably mounted onto the inner ring portion.

Preferably, the pair of flanges are secured onto the inner ring portion by means of a plurality of screws.

In accordance with a preferred embodiment of the invention, the flanges have an inner diameter which is sized to conform to a user's finger size and are thus interchangeable in order to adapt a ring to the user's finger size.

More generally, in accordance with a preferred embodiment of the present invention, the apparatus for removably retaining the outer generally annular portion in rotatable mounting engagement with the interchangeable inner ring portion has an inner diameter which is sized to conform to a user's finger size and is thus interchangeable in order to adapt the ring to the user's finger size.

Accordingly, in accordance with a preferred embodiment of the invention at least one of the elements of the ring has an inner diameter which is sized to conform to a user's finger size and is thus interchangeable in order to adapt the ring to the user's finger size.

BRIEF DESCRIPTION OF PREFERRED EMBODIMENTS

The present invention will be understood and appreciated more fully from the following detailed description, taken in conjunction with the drawings in which.

DETAILED DESCRIPTION OF A PREFERRED EMBODIMENT

Reference is now made to FIGS. 1-5B, which illustrate a ring constructed and operative in accordance with a preferred embodiment of the present invention. The ring comprises an inner ring portion 10, preferably in the form of a cylinder having an inner diameter which is sized to fit all finger sizes or at least a large range of user's finger sizes. Portion 10 is preferably formed with a plurality of radially outward extending flange engagement protrusions 12, whose function will be explained hereinbelow. Normally, a retail outlet, such as a jewelry store, will stock a relatively small first plurality of identical portions 10.

Figure 3:
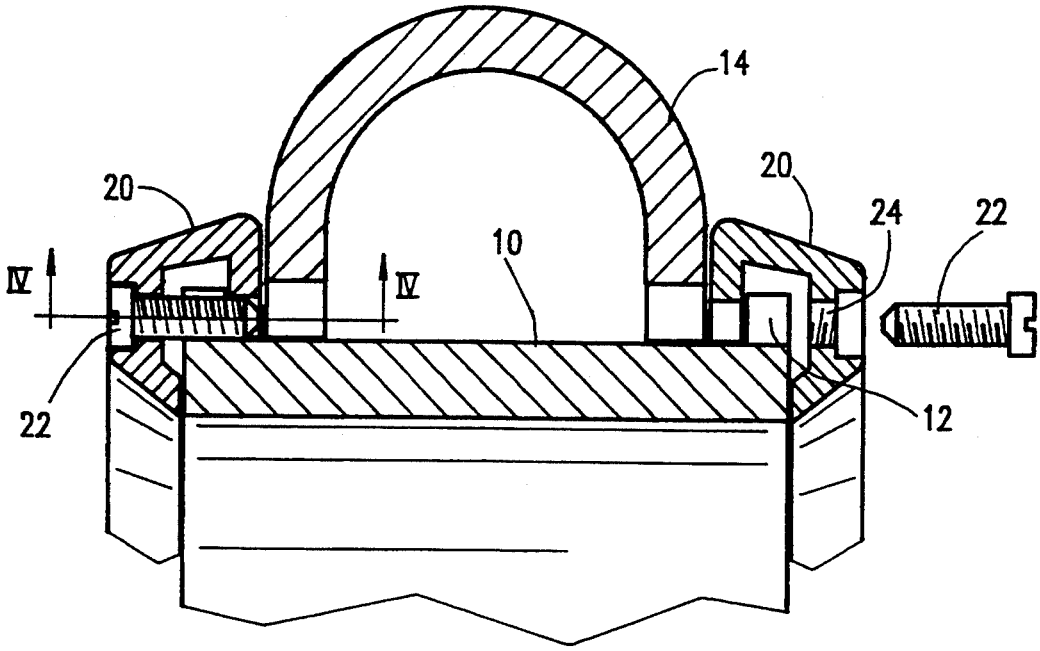
FIG. 3 is a sectional illustration of the interengagement of part of the ring of FIGS. 1 and 2.

An outer generally annular portion 14 is arranged to be rotatably mounted onto the inner ring portion 10 and also need not be matched to the finger size of the user. Annular portion 14 is preferably formed with curved convex cross section as seen in FIG. 3 and is formed with cut outs 16 in order to accommodate protrusions 12. Annular portion 14 is mounted onto inner portion 10 by simply aligning cut outs 16 at the locations of protrusions 12 and juxtaposing the annular portion 14 radially outward of inner portion 10. It is appreciated that annular portion 14 is free to rotate with respect to inner portion 10 about the cylindrical axis thereof. The inner diameter of annular portion 14, defined by interior edges 18 thereof, is preferably arranged to be matched to and slightly larger than the outer diameter of inner portion 10.

The outer annular portion 14 is preferably removably retained onto inner portion 10 by a pair of flanges 20, which are attached by screws 22 onto inner ring portion 10 by means of protrusions 12.

Outer annular portion 14 is formed of any suitable material, such as a precious metal and may have precious stones set therein, which stones may vary in size, quantity, shape and color.

The technique and structure of engagement between flanges 20 and inner portion 10 in accordance with a preferred embodiment of the present invention will now be described with particular reference to FIGS. 3-5B.

Figure 2:
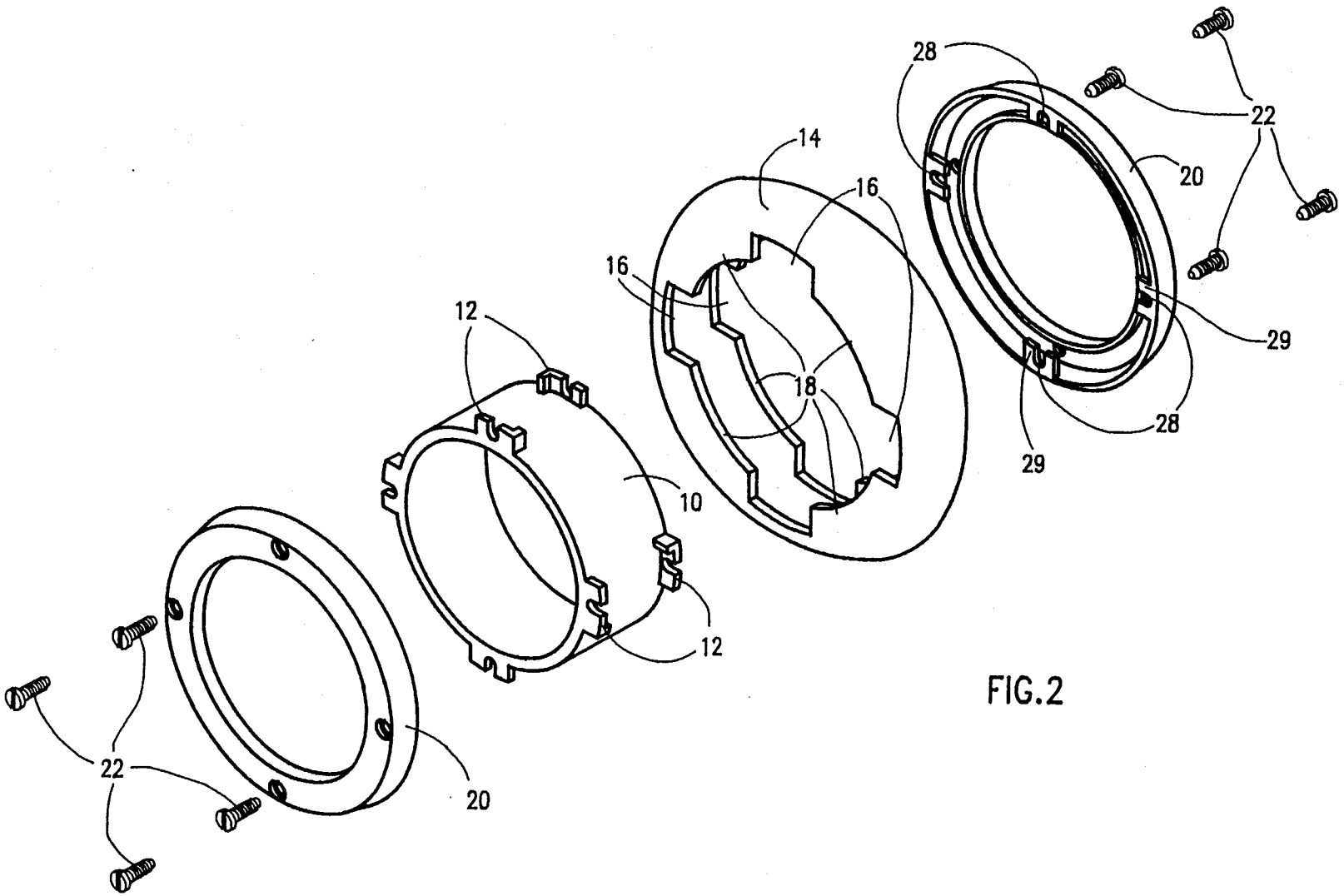
FIG. 2 is an exploded view illustration of the ring of FIG. 1.
Figure 4:
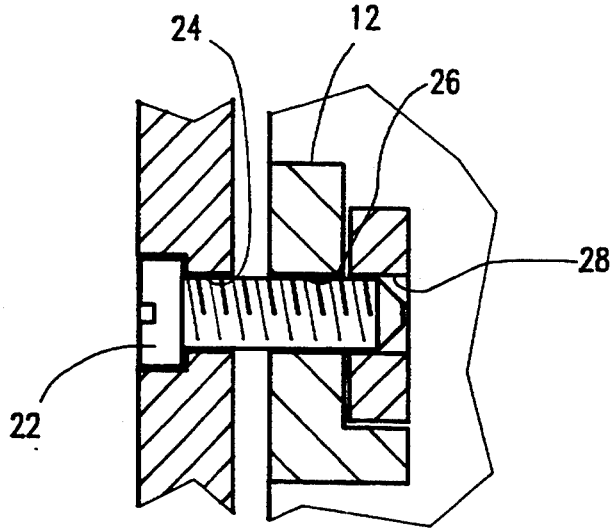
FIG. 4 is a sectional illustration taken along the lines IV—IV in FIG. 3.

As seen in FIGS. 3 and 4, each screw 22 threadably engages a threaded passageway 24 formed in flange 20 at a recessed portion of an outer portion thereof. The screw 22 passes through a non-threaded recess 26 formed in each protrusion 12 and also engages a corresponding non-threaded recess 28 located in a protrusion 29 and opposite each passageway 24 and formed in an inner portion of flange 20 axially spaced from passageway 24, as best seen in FIGS. 2 and 4.

The assembly technique for the ring of FIGS. 1–5B includes the following steps following juxtaposition of annular portion 14 over inner portion 10. Initially, each flange 20 is axially brought into engagement with the inner portion 10 when the recesses 28 are rotationally displaced from the protrusions 12.

Figure 1:
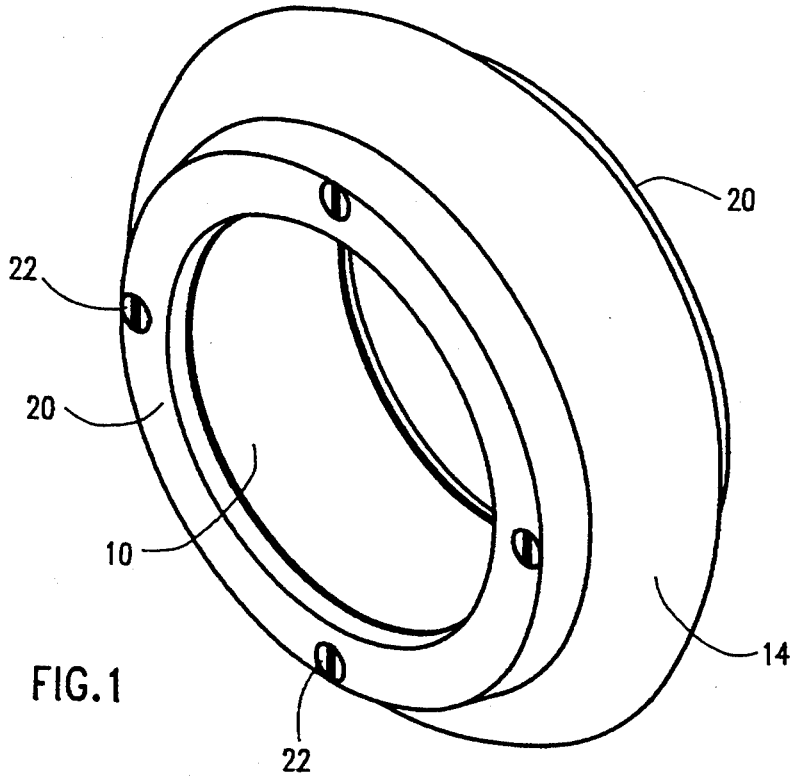
FIG. 1 is a pictorial illustration of a ring constructed and operative in accordance with a preferred embodiment of the present invention.
Figure 5B:
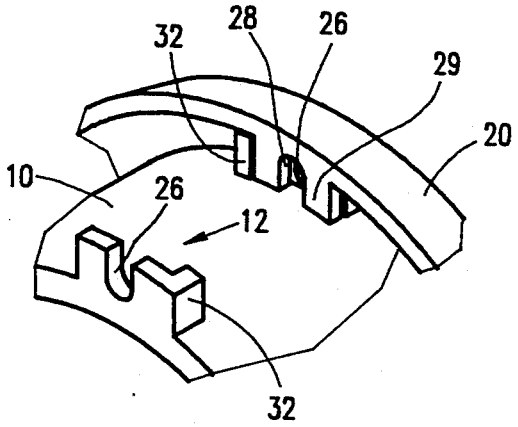
FIGS. 5A and 5B are illustrations of two sequential stages in the assembly of the ring of FIGS. 1—4.
Figure 5A:
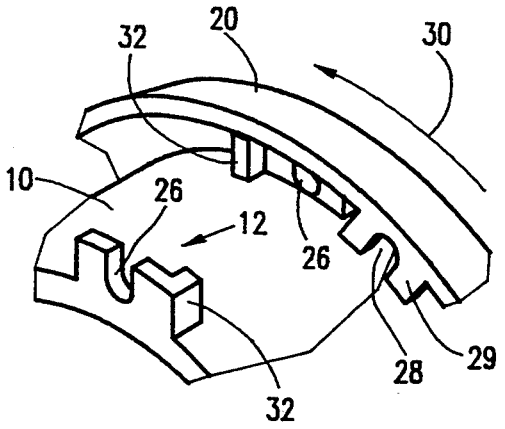

Thereafter, as seen in FIG. 5A, the flange 20 is rotated as indicated by arrow 30 until each protrusion 29 comes into contact with a stop 32 forming part of each corresponding protrusion 12, thereby aligning each recess 28 with each recess 26, as shown in FIG. 5B. After such alignment is complete, tightening of the screws 22 in each threaded passageway 24, retains each flange 20 tightly against inner portion 10, but without impeding rotatability of portion 14 relative to inner portion 10.

Figure 6:
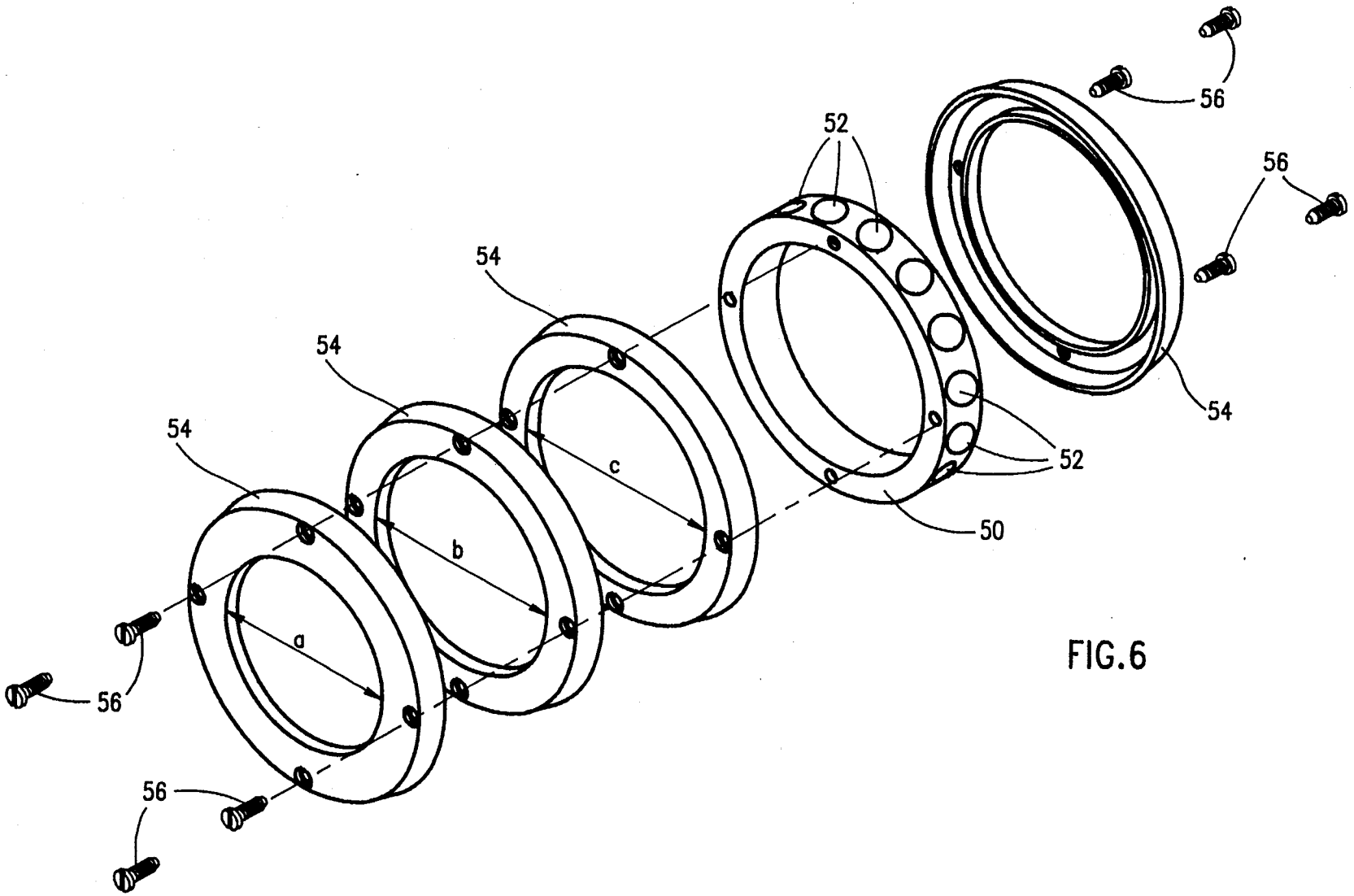
FIG. 6 is an exploded view illustration of an alternative embodiment of ring constructed and operative in accordance with a preferred embodiment of the present invention.

Reference is now made to FIG. 6 which illustrates another embodiment of ring constructed and operative in accordance with a preferred embodiment of the present invention. In this embodiment the ring comprises an ornamental portion 50 which may be made of any suitable material, such as gold or other precious metal and may have jewels 52 mounted thereon. A pair of flanges 54, having a desired inner diameter are mounted onto opposite sides of the ornamental portion, as by screws 56. FIG. 6 illustrates a plurality of flanges 54, each having a different inner diameter, which may readily and modularly mounted onto the same ornamental portion 50, thus enabling the ring to be readily matched to a wearer's finger size.

It is a particular feature of the present invention that the flanges may have an inner diameter which is sized to conform to a user's finger size and are thus interchangeable in order to adapt a ring to the user's finger size. Accordingly, a retail outlet may stock a relatively large second plurality of flanges 20 to match finger sizes of users, while only stocking a relatively smaller first plurality of inner portions 10 and annular portions 14, or ornamental portions 50, which contain substantially more precious metal and precious stones and thus involve much greater inventory cost.

It will be appreciated by persons skilled in the art that the present invention is not limited by what has been particularly shown and described hereinabove. Rather the scope of the present invention is defined only by the claims which follow:

I claim:

1. A ring including a ring portion, a pair of flanges which support the ring portion on a user's finger, the internal diameter of the pair of flanges being sized to fit the user's finger, threaded attachment apparatus for removably and interchangeably securing the pair of flanges to the ring portion; and cooperative rotatably lockable engagement portions formed on said pair of flanges and said ring portion.

2. A ring according to claim 1 and wherein said threaded attachment apparatus comprises a plurality of screws.

3. A ring according to claim 2 and wherein said flanges are interchangeable in order to adapt a ring to the user's finger size.

4. A ring according to claim 2 and wherein said ring portion comprises an ornamental ring portion and an inner ring portion onto which said pair of flanges are threadably mounted and with respect to which said ornamental ring portion is rotatable.

5. A ring according to claim 4 and wherein said inner ring portion includes at least one threaded socket.

6. A ring according to claim 1 and wherein said flanges are interchangeable in order to adapt a ring to the user's finger size.

7. A ring according to claim 1 and wherein said ring portion comprises an ornamental ring portion and an inner ring portion onto which said pair of flanges are threadably mounted and with respect to which said ornamental ring portion is rotatable.

8. A ring according to claim 7 and wherein said inner ring portion includes at least one threaded socket.

* * * * *